US008607667B2

(12) United States Patent
Li et al.

(10) Patent No.: US 8,607,667 B2
(45) Date of Patent: Dec. 17, 2013

(54) MANUFACTURING RAZOR BLADES

(75) Inventors: Cheng-Jih Li, Hopkinton, MA (US); Stephen F. Hobbs, West Bridgewater, MA (US); Nicolae Neamtu, Scottsdale, AZ (US)

(73) Assignee: The Gillette Company, Boston, MA (US)

( * ) Notice: Subject to any disclaimer, the term of this patent is extended or adjusted under 35 U.S.C. 154(b) by 1471 days.

(21) Appl. No.: 11/259,552

(22) Filed: Oct. 26, 2005

(65) Prior Publication Data

US 2007/0089567 A1 Apr. 26, 2007

(51) Int. Cl.
*B21D 53/64* (2006.01)
*B21K 5/00* (2006.01)

(52) U.S. Cl.
USPC ..... 76/116

(58) Field of Classification Search
USPC ..... 76/116, 104.1, DIG. 8, DIG. 9, 101.1; 72/205, 206, 185–187, 203, 204
See application file for complete search history.

(56) References Cited

U.S. PATENT DOCUMENTS

| | | | | | |
|---|---|---|---|---|---|
| 1,370,381 | A | * | 3/1921 | Tarbox | 76/1 |
| 1,732,244 | A | * | 10/1929 | Salzman | 148/646 |
| 1,734,554 | A | | 11/1929 | Behrman | |
| 1,877,758 | A | * | 9/1932 | Kylberg | 72/333 |
| 1,957,602 | A | * | 5/1934 | Kylberg | 451/191 |
| 2,016,770 | A | * | 10/1935 | De Bats | 72/203 |
| 2,093,874 | A | * | 9/1937 | Stargardter | 76/104.1 |
| 2,134,526 | A | * | 10/1938 | McLaughlin | 72/187 |
| 2,226,948 | A | * | 12/1940 | Simons | 72/137 |
| 2,275,517 | A | | 3/1942 | Fay | |
| 2,409,604 | A | * | 10/1946 | Young | 76/104.1 |
| 2,593,307 | A | | 4/1952 | Jacobsen | |
| 3,279,283 | A | * | 10/1966 | Craig | 76/104.1 |
| 3,468,195 | A | * | 9/1969 | La Cas | 76/104.1 |
| 3,600,804 | A | | 8/1971 | Brown | |
| 3,847,683 | A | * | 11/1974 | Sastri | 148/608 |
| 4,034,587 | A | * | 7/1977 | Schwarz | 72/194 |
| 4,106,500 | A | * | 8/1978 | Burchart | 601/72 |
| 4,109,500 | A | * | 8/1978 | Franek | 72/203 |
| 4,259,126 | A | * | 3/1981 | Cole et al. | 148/621 |
| 4,265,055 | A | * | 5/1981 | Cartwright et al. | 451/45 |
| 5,337,592 | A | * | 8/1994 | Paulson | 72/177 |
| 5,458,025 | A | | 10/1995 | Neamtu | |
| 5,661,907 | A | | 9/1997 | Apprille, Jr. | |
| 5,701,788 | A | | 12/1997 | Wilson et al. | |
| 6,357,273 | B1 | * | 3/2002 | Noe et al. | 72/234 |
| 6,629,475 | B1 | | 10/2003 | Neamtu et al. | |
| 6,957,598 | B2 | * | 10/2005 | Neamtu et al. | 76/104.1 |
| 2004/0244539 | A1 | * | 12/2004 | Korb et al. | 76/104.1 |

FOREIGN PATENT DOCUMENTS

| | | |
|---|---|---|
| GB | 548647 | 10/1942 |
| WO | WO 98/05478 | 2/1998 |

OTHER PUBLICATIONS

Hobbs et al., U.S. Appl. No. 11/259,528, entitled "Manufacturing Razor Blades", filed Oct. 26, 2005.

* cited by examiner

*Primary Examiner* — Robert Scruggs
(74) *Attorney, Agent, or Firm* — Jay A. Krebs

(57) ABSTRACT

A method of manufacturing razor blades from a strip material including reducing the thickness of the strip material by at least 10% and converting the strip material into razor blades.

7 Claims, 4 Drawing Sheets

MANUFACTURING RAZOR BLADES

TECHNICAL FIELD

This invention relates to manufacturing razor blades.

BACKGROUND

Razor blades are typically made from a continuous strip of stock material that is hardened and sharpened while the strip travels along a processing line. The strip is then divided in blade length sections used in the manufacture of individual razor cartridges.

In some applications, blades are supported on bent supports that are slidably mounted in the cartridge housing to move up and down during shaving. For example, FIG. 1 shows cartridge 10 with blades 12 slidably mounted in housing 14, and FIG. 2 shows a blade 12 on a support 16. In these applications, the blades cannot overlap and thus have a small dimension "a" from the cutting edge 18 to the back edge 20. The strip material and blade sections, however, must have a sufficient distance from the front edge to the back edge in order to properly secure and hold the material and sections during processing and attaching to blade supports. It thus is necessary to remove a portion of the blade material after processing and attaching so that the blade will have the desired small dimension from the cutting edge to the back edge. In some applications, the rear section 22, shown in FIG. 3, is removed by bending the rear section 22 between 60° and 90° with respect to the front section 24 after the front section has been attached to the blade support. FIG. 3 also shows spot weld 26, used to attach blade 12 to support 16. There typically is an upturned portion at the rear edge 20 of the attached blade section where the rear section has been removed. In some cases the rear section 22 is not easily removed.

In U.S. Pat. No. 6,629,475, a method of manufacturing razor blades is described in which the strip material is offset to provide a portion 22 that is easier to remove.

SUMMARY

The invention generally relates to methods of manufacturing razor blades from a strip material. In one aspect of the invention, the method includes reducing the maximum thickness of the strip material by at least 10%, and then converting the strip material into razor blades. The thickness of the strip material can be reduced, for example, by passing the strip material between rollers. In some embodiments, the maximum thickness of the strip material is reduced by at least 20%, at least 30%, or at least 40%.

In preferred embodiments, reducing the thickness of the strip material is performed while the strip material is moving in the lengthwise direction on a processing line and the strip material is under tension in the lengthwise direction. The reduction in thickness of the strip material reduces the tension on the strip material. In some embodiments, the method further includes increasing or maintaining the tension on the strip material after reducing the thickness of the strip material.

The strip material has a lengthwise-extending blade edge region that is converted into blade edges during the method. In some embodiments, the method further includes pressing a portion of the lengthwise-extending blade edge region to provide the portion with a thickness that is less than the thickness of the strip material adjoining the lengthwise-extending blade edge region. The portion may be, for example, at least 15%, at least 30%, at least 50%, at least 70%, at least 90%, or even about 100% of the strip material that becomes the blade edges. Pressing can provide the lengthwise-extending blade edge portion with upper and lower beveled surfaces. In some embodiments, reducing the thickness and pressing the strip material are carried out approximately simultaneously. This has the potential advantage of avoiding arching of the strip material, which potentially could occur if pressing is performed in the absence of reducing the thickness of the strip material generally.

In some embodiments, the method further includes offsetting a first lengthwise-extending portion of the strip material from a second lengthwise-extending portion of the strip material. The offset may be, for example, between about 10% and about 45%, and preferably between about 20% and 35%, of the thickness of the strip material. In some embodiments, the method further includes flattening the first lengthwise-extending portion and the second lengthwise-extending portion to remove at least 50%, 85%, or 90% of the offset.

In some embodiments, reducing the thickness, pressing, and offsetting the strip material are carried out approximately simultaneously.

In some embodiments, the thickness of the strip material is reduced two, three, or more times at different stations while moving in the lengthwise direction.

In another aspect of the invention, the method includes reducing the thickness of the strip material by at least 10% across at least 50% of the width of the strip material, and then converting the strip material into razor blades.

Other aspects of the invention include the strip materials made using any of the above methods, and razor blades and razor blade precursors made using any of the above methods.

When reducing the thickness of the strip, the material is squeezed toward the width and the length direction of the strip. By increasing or maintaining the speed of the strip material in the length direction, the squeezed material will transfer more into the length direction than into the width direction. Since the total length of the strip material determines the number of blades produced from a strip material or maintaining the total length means more razor blades can be produced from a strip material.

"Strip material" means an elongated, flat strip of material, for example, stainless steel or another metal that is at least 500 feet, at least 1,000 feet, .or even at least 5,000 feet long. A strip material can have, for example, a width between 0.1 inch and 2 inches, or between 0.2 inch and 1.5 inches.

Other aspects, features, and advantages of the method will be apparent from the Figures, the Detailed Description, and from the claims.

DESCRIPTION OF DRAWINGS

Like reference symbols in the various drawings indicate like elements.

DETAILED DESCRIPTION

Figure 1:
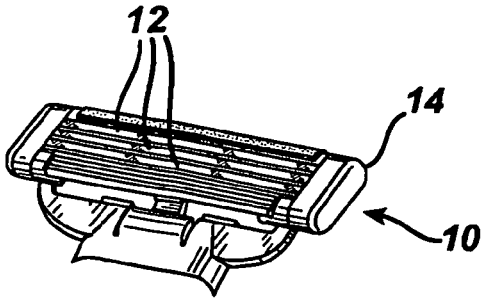
FIG. 1 PRIOR ART
FIG. 1 is a perspective view of a shaving razor cartridge.
Figure 2:
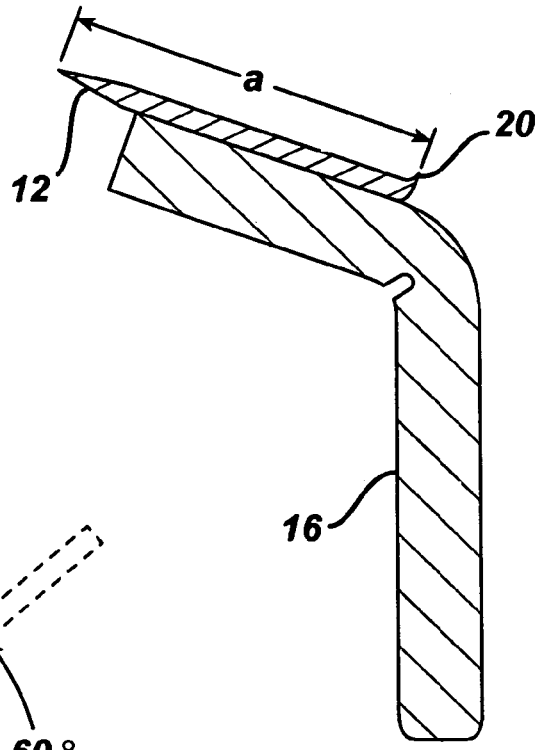
FIG. 2 PRIOR ART
FIG. 2 is a section showing a prior art razor blade used in the FIG. 1 cartridge.
Figure 3:
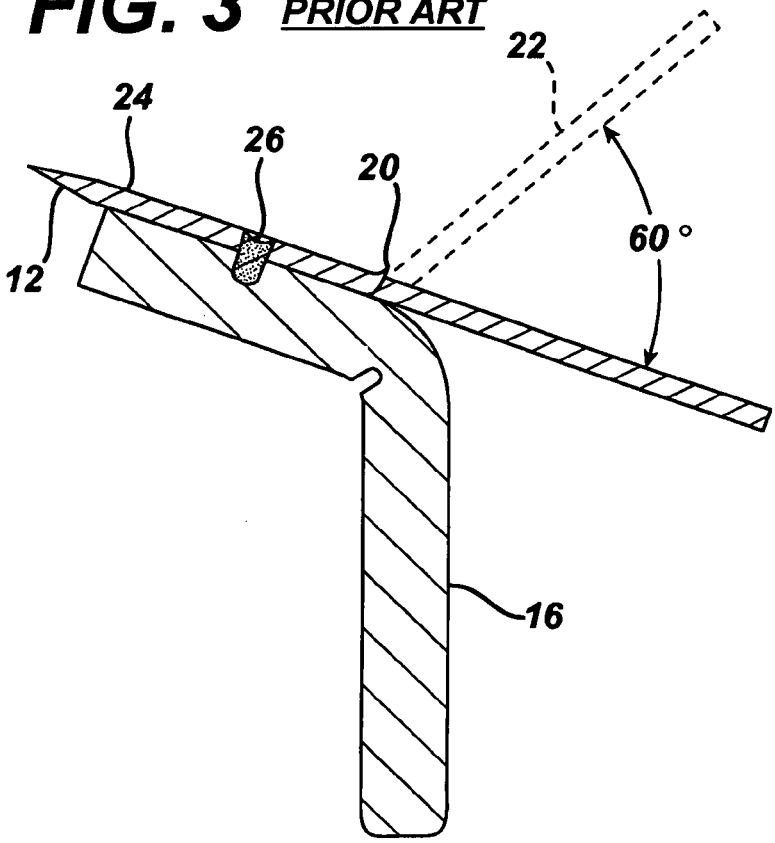
FIG. 3 PRIOR ART
FIG. 3 is a section showing the FIG. 2 blade prior to removal of a rear section used to engage the blade during processing and attaching.
Figure 4:
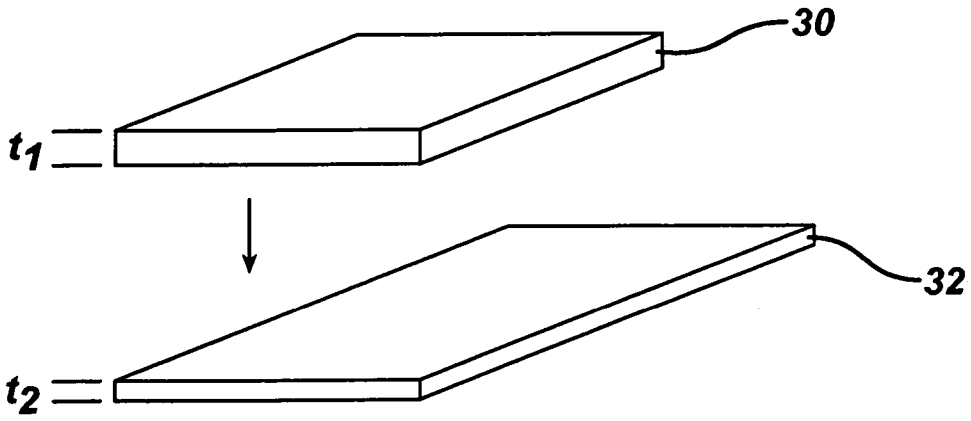
FIG. 4 is a perspective view of a portion of a strip material before and after its thickness has been reduced.

Referring to FIG. 4, a stainless steel strip material 34 has a thickness ($t_1$) of between 0.003 inch and 0.008 inch, for example, between 0.005 inch and 0.007 inch. The conversion of strip material 34 into razor blades will be discussed below. As part of that conversion, the strip material is passed between rollers that thin the strip material to a thickness ($t_2$) of between 0.001 inch and 0.005 inch, for example, 0.003 inch or 0.004 inch.

Figure 5:
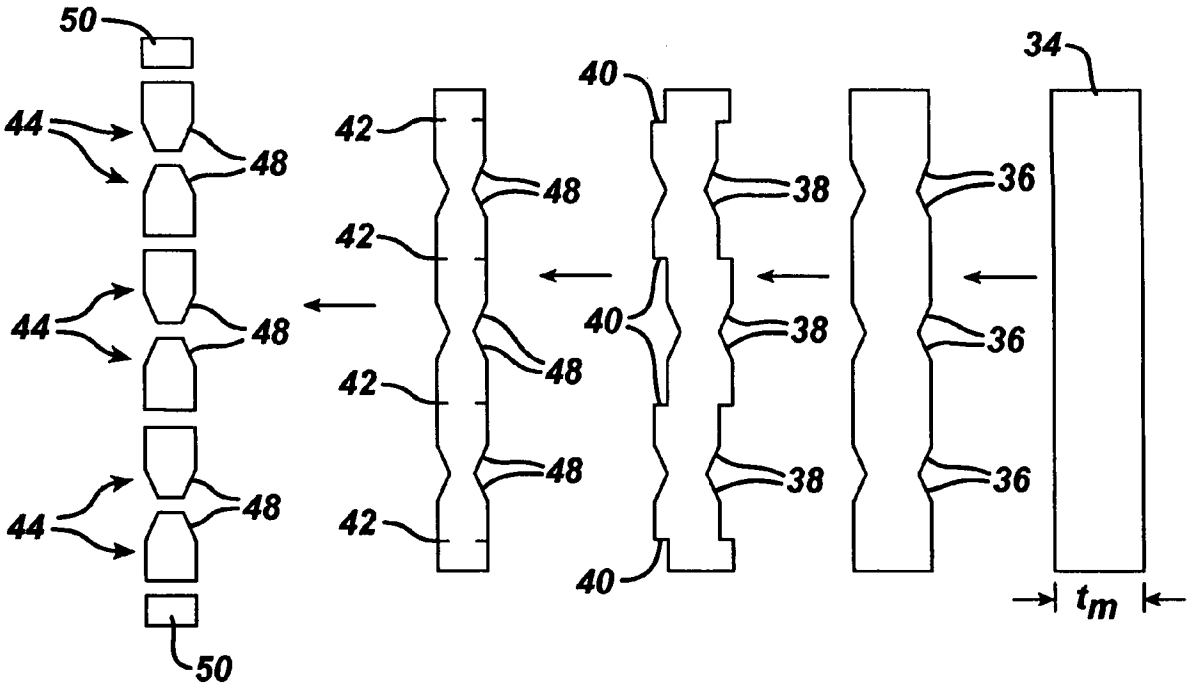
FIG. 5 is a flow chart of a method for making razor blades that also provides a section view through the thickness of the strip material.

Referring to FIG. 5, strip material 34 is passed between three sets of rollers. Strip material 34 has an initial maximum thickness ($t_m$). The first set of rollers reduces the maximum thickness of the strip material by, for example, 20% to 30%. Strip material 34 also is rolled down at three locations to provide beveled surfaces 36. The location having beveled surfaces 36 have a thickness that is less than the maximum thickness of the strip. Beveled surfaces 36 ultimately become the blade edges on the razor blades made from strip material 34. Reducing the thickness of strip materials in the region(s) that become the blade edges is described in U.S. Ser. No. 11/259,528, which is owned by the same owner as the present application, was filed on the same day as the present application, and is hereby incorporated by reference.

Strip material 34 then is pressed between a second set of rollers that reduce the maximum thickness of the strip material, for example, by an additional 20% to 30%. Strip material 34 also is rolled down further to provide enhanced beveled surfaces 38, and also is offset lengthwise at four locations 40 along its length. The strip material has the same (maximum) thickness on both sides of offset locations 40. The locations having beveled surfaces 38 have a thickness that is less than the maximum thickness of the strip. Offsetting is described in U.S. Ser. No. 11/259,553, which is owned by the same owner as the present application, filed on the same day as the present application and is incorporated by reference. Offsetting is also described in U.S. Pat. No. 6,629,475, which is hereby incorporated by reference. The combination of pressing to provide beveled surfaces and offsetting is described in U.S. Ser. No. 11/259,528, which already has been incorporated by reference.

Strip material 34 then is pressed between a third set of rollers that reduce the maximum thickness of the strip material, for example, by a further 20% to 30%. The additional thinning also stretches the beveled surfaces 38, providing beveled surfaces 48. The rollers flatten the offset location 40 to provide weakened regions 42. In the embodiment shown, flattening removes most or all of the offset, and the strip material has the same (maximum) thickness on both sides of weakened regions 42. The locations having beveled surfaces 38 have a thickness that is less than the maximum thickness of the strip. Flattening is described in U.S. Ser. No. 11/259,528 and U.S. Ser. No. 11/259,553, both of which already have been incorporated by reference.

Strip material 34 then is separated lengthwise between adjoining beveled surfaces 48 and at weakened region 42, either before or after heat treatment, to provide portions 44 and end portions 50, which are discarded. Beveled surfaces 48 are sharpened to provide blade edges, and portions 44 are chopped into razor blade length sections (steps not shown). The resultant razor blades can then be welded to a support in a razor cartridge (step not shown).

Figure 6:
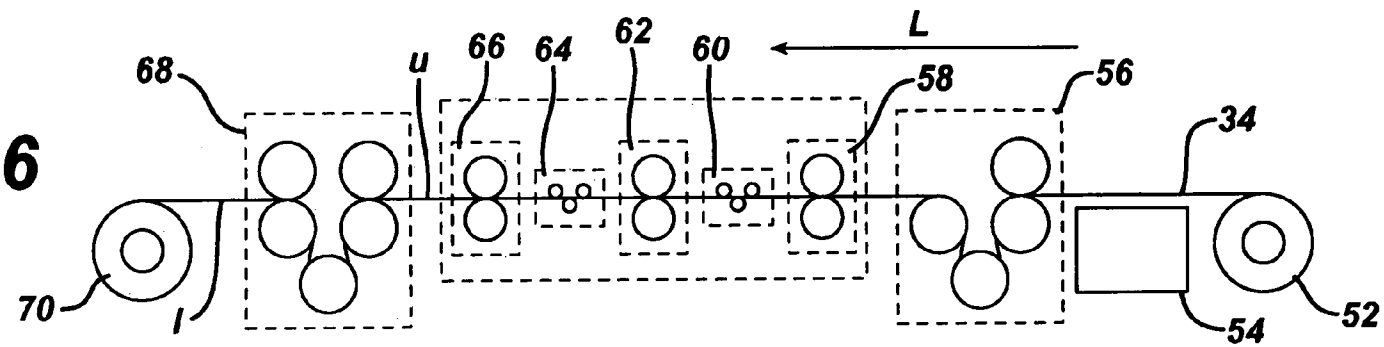
FIG. 6 is a diagrammatic plan view of a process line for performing some of the steps in FIG. 5.

Referring to FIG. 6, a process line for performing the thinning, rolling down, and offset/flattening process in FIG. 5 includes an unwind station 52 for providing strip material 34. Strip material 34 moves lengthwise in direction L and has upper (u) and lower (1) surfaces. Strip material 34 passes through weld station 54 and tension leveling station 56. Weld station 34 is used when the end of one roll of strip material 34 needs to be attached to the beginning end of a subsequent roll; tension leveling station 46 maintains the appropriate tension on strip material 34 at the entry end of the process line.

Strip material 34 next passes through a set of rollers 58 that thins the strip material and also rolls down the strip material to provide beveled surfaces 36. Strip material 34 then passes through tension metering station 60. Tension metering station 60 adjusts the tension of the strip material by increasing or maintaining the speed at which the strip material moves in the lengthwise direction through the process line. The thinning of the strip material by rollers 58 results in an increase in the overall length of the strip material, and increasing or maintaining the speed of the strip material at tension metering station 60 accommodates this increase and maintains a required tension on the strip material in the lengthwise direction.

Strip material 34 then passes through a set of rollers 62 that thins the strip material further, rolls down beveled surface 36 further to provide beveled surfaces 38, and offsets the strip material at locations 40. Subsequently, strip material 34 passes through a second tension metering station 64, which adjusts the speed of the strip material in the same manner as tension metering station 60. The strip material next passes through a set of rollers 66 that thins the strip material further and flattens location 40 to provide weakened region 42. The strip material subsequently passes through a further tension leveling station 68 and is wound onto a spool at winding station 70.

The strip material moves at a substantially greater speed in the lengthwise direction at winding station 70 that it did at unwind station 52. The speed may be increased for example, at least 15%, at least 25%, at least 40%, or even at least 50%. In the process line shown in FIG. 6, strip material moves at about 800 feet per minute at unwind station 52 and about 1200 feet per minute at winding station 70.

Figure 7:
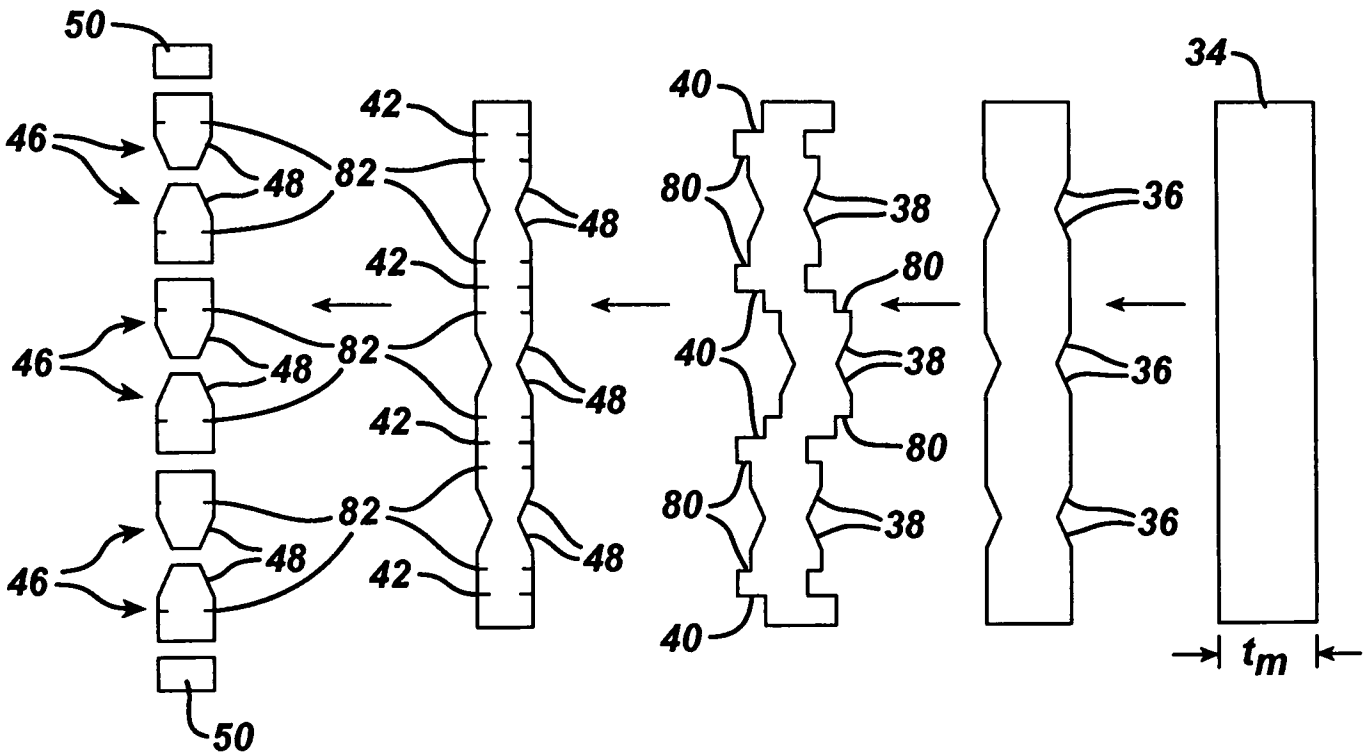
FIG. 7 is a flow chart of a method for making razor blades that also provides section view of the strip material.

Referring to FIG. 7, in an alternative embodiment strip material 34 also is passed between three sets of rollers. The first set of rollers are the same as discussed previously in connection with the process shown in FIGS. 5 and 6. The second set of rollers further thins the strip material, further rolls down beveled surfaces 36 to provide beveled surfaces 38, and offsets the strip material at locations 40 as discussed previously in connection with the process shown in FIGS. 5 and 6. However, the second set of rollers also offsets the strip material at six locations 80; the at offset locations 80 is less than at locations 40. The third set of rollers thins and flattens the strip material in the same manner as discussed previously in connection with the processes shown in FIGS. 5 and 6; the resulting strip material has second weakened regions 82 in addition to weakened regions 42.

Strip material 34, before of after heat treatment, then is separated lengthwise between adjoining beveled surfaces 48 and weakened regions 42 to provide portions 46 and end portions 50, which are discarded. Beveled surfaces 48 are sharpened, and portions 46 are chopped into blade length segments (steps not shown) to provide razor blade precursors including a removable portion. The razor blade precursor, or razor blades derived from the precursors, can be mounted on supports in a razor cartridge as described in U.S. Ser. No. 11/259,553 (see, for example, FIG. 4), which already has been incorporated by reference herein.

Other embodiments are within the claims. For example, U.S. Ser. No. 11/259,528 and U.S. Ser. No. 11/259,553, which already have been incorporated by reference, describe a number of embodiments in which a strip material is pressed, offset, and/or flattened; any of these embodiments described in these applications can be used in combination with thinning.

In addition, although in the embodiment in FIGS. 5 and 6 the thickness of the strip material on either side of each location 40 and 42 is the same, in other embodiments the thickness on one side can be greater than on the other side. The thickest region of the strip material defines the maximum thickness of the strip material.

Moreover, although in the embodiment shown in FIGS. 5 and 6 the strip material is thinned across its width (w), in other embodiments the strip material is thinned across only at least 50%, 75%, or 90% of its width.

Finally, although the embodiments in FIGS. 5-7 involve making six strands that ultimately are converted to razor blades, in other embodiments the strip material can provide, for example, 2, 3, 4, 5, 7, 8, 9, 10, or even more strands.

What is claimed is:

1. A method of manufacturing razor blades from a strip material having upper and lower surfaces, a maximum thickness, and lengthwise-extending edge regions that are converted to blade edges during the method, the method comprising the steps of:

(a) providing the strip material;

(b) contacting the upper and lower surfaces of the strip of material with a first set of rollers to reduce the maximum thickness of the strip material by at least 10% and to roll down the material at locations to provide beveled surfaces in the upper and lower surfaces at the lengthwise extending edge regions of the strip material, wherein the beveled surfaces have a thickness which is less than the maximum thickness;

(c) contacting the upper and lower surfaces of the strip of material with a second set of rollers to reduce the maximum thickness of the strip material by an additional amount and to offset the material at locations with the beveled surfaces at the lengthwise extending edge regions placed in between the offsets;

(d) contacting the upper and lower surfaces of the strip material with a third set of rollers to reduce the maximum thickness of the strip material by an additional amount and to flatten the offsets and provide weakened regions;

(e) separating the strip material lengthwise between the beveled surfaces and the weakened regions; and (f) sharpening the beveled surfaces to provide blade edges.

2. The method of claim 1, wherein during step (b) the maximum thickness of the strip material is reduced by at least 20%.

3. The method of claim 1, wherein during step (c) the maximum thickness of the strip material is reduced by at least 30%.

4. The method of claim 1, wherein during step (d) the maximum thickness of the strip material is reduced by at least 40%.

5. The method of claim 1, wherein step (b) is carried out with the strip material moving in the lengthwise direction on a processing line and the strip material is under tension in the lengthwise direction prior to step (b), and wherein the tension is reduced during steps (b), (c), and (d) as a result of the reduction in maximum thickness of the strip material, the method further comprising adjusting the tension on the strip material after step (b).

6. The method of claim 1, wherein the offsets are flattened at least 50% during step (d).

7. The method of claim 1, wherein the strip material comprises stainless steel.

* * * * *